US008934825B2

(12) United States Patent
Amano et al.

(10) Patent No.: US 8,934,825 B2
(45) Date of Patent: Jan. 13, 2015

(54) FIXING DEVICE AND IMAGE FORMING APPARATUS

(71) Applicant: Fuji Xerox Co., Ltd., Minato-ku, Tokyo (JP)

(72) Inventors: Junpei Amano, Kanagawa (JP); Norimasa Fujiwara, Kanagawa (JP); Kouichi Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 62 days.

(21) Appl. No.: 13/671,947

(22) Filed: Nov. 8, 2012

(65) Prior Publication Data

US 2013/0272757 A1 Oct. 17, 2013

(30) Foreign Application Priority Data

Apr. 12, 2012 (JP) ..... 2012-090685

(51) Int. Cl.
*G03G 15/20* (2006.01)

(52) U.S. Cl.
USPC ..... 399/329; 399/328

(58) Field of Classification Search
None
See application file for complete search history.

(56) References Cited

U.S. PATENT DOCUMENTS

2003/0103788 A1 * 6/2003 Yura et al. ..... 399/329

FOREIGN PATENT DOCUMENTS

JP 2004-184446 A 7/2004
JP 2005-221533 A 8/2005

* cited by examiner

*Primary Examiner* — Clayton E LaBalle
*Assistant Examiner* — Jas Sanghera
(74) *Attorney, Agent, or Firm* — Sughrue Mion, PLLC

(57) ABSTRACT

A fixing device includes a rotatable endless belt, a heating source that heats the belt, a pad member having a sliding surface abutting on an inner surface of the belt, and a pressure roller that presses an outer surface of the belt toward the sliding surface and rotates to rotate the belt. The pressure roller works together with the belt to fix an unfixed toner image onto a medium that bears the unfixed toner image by allowing the medium to enter between the roller and the belt. Assuming that the sliding surface is divided into upstream and downstream regions in a moving direction of the belt, the upstream and downstream regions both have recessed curved surfaces in the moving direction. A first curved surface corresponding to the upstream region has an average curvature that is larger than that of a second curved surface corresponding to the downstream region.

14 Claims, 6 Drawing Sheets

FIG. 6

| FIRST PAD TEMPERATURE | TARGET TEMPERATURE | |
|---|---|---|
| | PLAIN PAPER | THICK PAPER |
| 80°C | 110°C | 130°C |
| ⋮ | ⋮ | ⋮ |
| 100°C | 130°C | 150°C |
| ⋮ | ⋮ | ⋮ |
| 150°C | 180°C | 200°C |
| ⋮ | ⋮ | ⋮ |
| 200°C | 200°C | 200°C |

FIXING DEVICE AND IMAGE FORMING APPARATUS

CROSS-REFERENCE TO RELATED APPLICATIONS

This application is based on and claims priority under 35 USC 119 from Japanese Patent Application No. 2012-090685 filed Apr. 12, 2012.

BACKGROUND

1. Technical Field

The present invention relates to fixing devices and image forming apparatuses.

2. Summary

According to an aspect of the invention, there is provided a fixing device including an endless belt that rotates, a heating source that heats the belt, a pad member having a sliding surface that abuts on an inner surface of the belt, and a pressure roller that presses an outer surface of the belt toward the sliding surface and rotates so as to rotate the belt. The pressure roller works together with the belt so as to fix an unfixed toner image onto a medium that bears the unfixed toner image by allowing the medium to enter between the pressure roller and the belt. Assuming that the sliding surface is divided into an upstream region and a downstream region in a moving direction of the belt moving along the sliding surface, the upstream region and the downstream region both have recessed curved surfaces in the moving direction. Moreover, a first curved surface corresponding to the upstream region has an average curvature that is larger than that of a second curved surface corresponding to the downstream region.

BRIEF DESCRIPTION OF THE DRAWINGS

An exemplary embodiment of the present invention will be described in detail based on the following figures, wherein:

FIG. 6 is a table illustrating the relationship between a temperature detected by a first pad temperature sensor and a target temperature.

DETAILED DESCRIPTION

An exemplary embodiment of the present invention will be described below with reference to the drawings.

Figure 1:
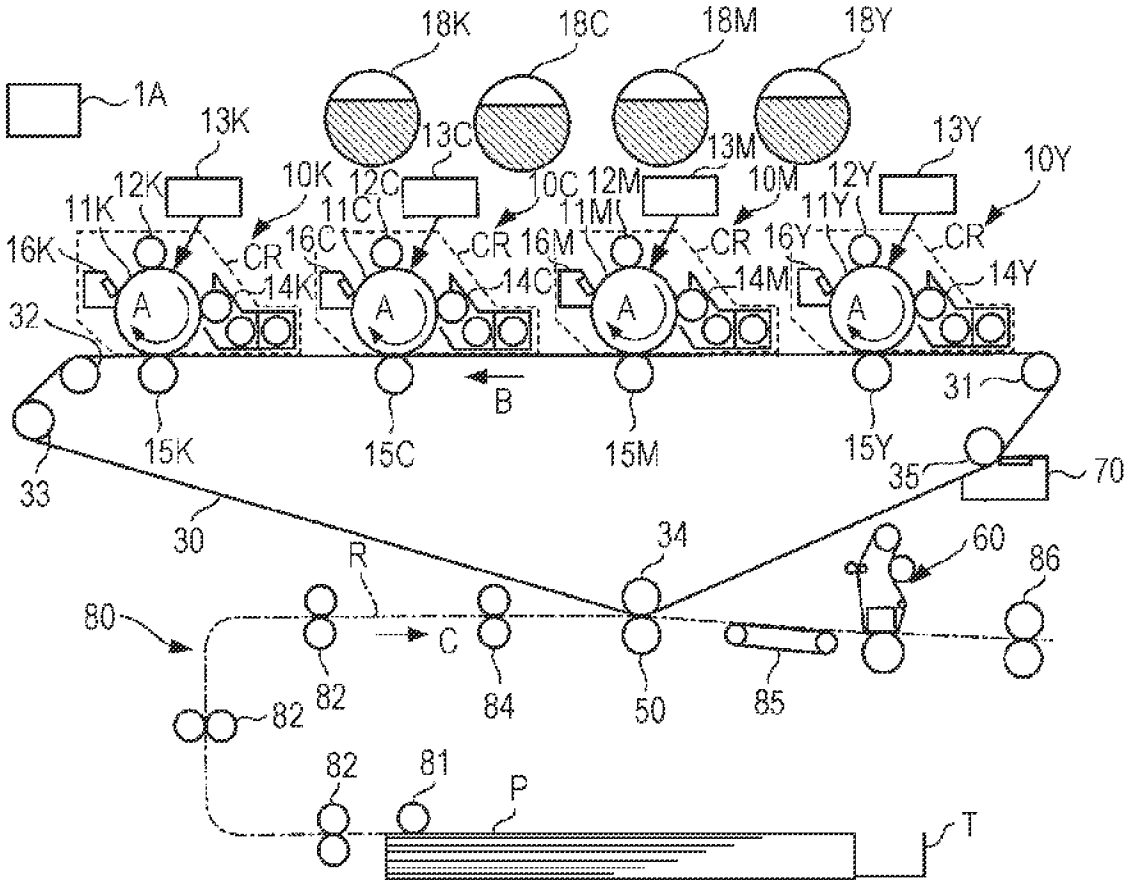
FIG. 1 illustrates the configuration of an image forming apparatus according to an exemplary embodiment of the present invention.

FIG. 1 illustrates the configuration of an image forming apparatus according to an exemplary embodiment of the present invention.

An image forming apparatus 1 shown in FIG. 1 is a tandem-type color printer having yellow (Y), magenta (M), cyan (C), and black (K) image forming units 10Y, 10M, 10C, and 10K that are arranged in parallel to each other. The image forming apparatus 1 is capable of printing a monochrome image, as well as a full-color image constituted of toner images of four colors. Toner cartridges 18Y, 18M, 18C, and 18K contain Y, M, C, and K toners, respectively.

Because the four image forming units 10Y, 10M, 10C, and 10K substantially have the same configuration, the image forming unit 10Y corresponding to yellow will be described here as a representative of the units. The image forming unit 10Y includes a photoconductor drum 11Y, a charging unit 12Y, an exposure unit 13Y, a developing device 14Y, a first-transfer unit 15Y, and a photoconductor cleaner 16Y.

The photoconductor drum 11Y is provided with a photoconductor layer over a surface of a cylindrical base, and rotates in a direction indicated by an arrow A around an axis of the cylinder while bearing an image formed on the surface. The charging unit 12Y, the exposure unit 13Y, the developing device 14Y, the first-transfer unit 15Y, and the photoconductor cleaner 16Y are arranged around the photoconductor drum 11Y in that order in the direction of the arrow A.

The charging unit 12Y electrostatically charges the surface of the photoconductor drum 11Y. The charging unit 12Y is a charging roller that is in contact with the surface of the photoconductor drum 11Y. The charging unit 12Y receives a voltage with the same polarity as that of the toner in the developing device 14Y so as to electrostatically charge the surface of the photoconductor drum 11Y in contact therewith. The exposure unit 13Y radiates exposure light onto the surface of the photoconductor drum 11Y. The exposure unit 13Y emits laser light according to an image signal supplied from outside the image forming apparatus 1 and scans the laser light across the photoconductor drum 11Y. The developing device 14Y develops an image on the surface of the photoconductor drum 11Y by using a developer. The developing device 14Y is supplied with the toner from the toner cartridge 18Y. The developing device 14Y stirs the developer having a mixture of a magnetic carrier and the toner so as to electrostatically charge the toner and the magnetic carrier, and develops the image on the surface of the photoconductor drum 11Y by using the electrostatically-charged toner. The first-transfer unit 15Y is a roller that is opposed to the photoconductor drum 11Y with an intermediate transfer belt 30 interposed therebetween. When voltage is applied to the photoconductor drum 11Y, the first-transfer unit 15Y transfers a toner image on the photoconductor drum 11Y onto the intermediate transfer belt 30. The photoconductor cleaner 16Y cleans the surface of the photoconductor drum 11Y by removing unwanted matter therefrom, such as the toner remaining in an area of the surface of the photoconductor drum 11Y having undergone the transfer process by the first-transfer unit 15Y.

The image forming apparatus 1 also includes the intermediate transfer belt 30, a fixing device 60, a sheet transport unit 80, and a controller 1A. The intermediate transfer belt 30 is an endless belt wrapped around belt support rollers 31 to 35. The intermediate transfer belt 30 rotates in a direction indicated by an arrow B via the image forming units 10Y, 10M, 10C, and 10K and a second-transfer unit 50. Toner images of the respective colors are transferred onto the intermediate transfer belt 30 from the image forming units 10Y, 10M, 10C, and 10K. The intermediate transfer belt 30 moves while bearing these toner images.

The second-transfer unit 50 is a roller that rotates while nipping the intermediate transfer belt 30 and a sheet P together with a backup roller 34, which is one of the belt support rollers 31 to 35. The second-transfer unit 50 receives a voltage having a reversed polarity relative to the charge polarity of the toners so as to transfer the toner images on the intermediate transfer belt 30 onto the sheet P. Accordingly, the toner images are transferred onto the sheet P from the image forming units 10Y, 10M, 10C, and 10K. The combination of the image forming units 10Y, 10M, 10C, and 10K, the intermediate transfer belt 30, and the second-transfer unit 50 corresponds to an example of an image forming section according to an exemplary embodiment of the present invention.

The fixing device 60 fixes the toner images onto the sheet P. The fixing device 60 nips the sheet P and allows the sheet P to pass between a belt and a roller so as to heat and press the toners, thereby fixing the toner images onto the sheet P. The configuration of the fixing device 60 will be described later.

The sheet transport unit 80 transports the sheet P along a sheet transport path R that extends through the second-transfer unit 50 and the fixing device 60. The sheet transport unit 80 includes a feed roller 81, transport rollers 82, a registration roller 84, a transport belt 85, and an output roller 86. The feed roller 81 feeds a sheet P accommodated in a sheet container T, and the transport rollers 82 transport the fed sheet P. The registration roller 84 transports the sheet P to the second-transfer unit 50, and the output roller 86 outputs the sheet P to the outside.

With regard to the basic operation of the image forming apparatus 1 shown in FIG. 1, in the yellow image forming unit 10Y, the photoconductor drum 11Y is rotationally driven in the direction of the arrow A, and the surface of the photoconductor drum 11Y is electrostatically charged by the charging unit 12Y. The exposure unit 13Y radiates exposure light according to data related to the corresponding color in an image signal to the photoconductor drum 11Y. Specifically, the exposure unit 13Y radiates exposure light based on a yellow image signal included in the image signal supplied from the outside to the surface of the photoconductor drum 11Y so as to form an electrostatic latent image on the surface of the photoconductor drum 11Y. The developing device 14Y is supplied with yellow toner from the toner cartridge 18Y. The developing device 14Y develops the electrostatic latent image on the photoconductor drum 11Y by using the toner so as to form a toner image. The photoconductor drum 11Y rotates while bearing the yellow toner image formed on the surface thereof. The toner image formed on the surface of the photoconductor drum 11Y is transferred onto the intermediate transfer belt 30 by the first-transfer unit 15Y. After the transfer process, the toner remaining on the photoconductor drum 11Y is removed therefrom by the photoconductor cleaner 16Y.

The intermediate transfer belt 30 rotates in the direction of the arrow B. Similar to the image forming unit 10Y, the image forming units 10M, 10C, and 10K corresponding to the remaining colors, excluding yellow, form toner images corresponding to the respective colors. The toner images are superposed and transferred onto the intermediate transfer belt 30.

The sheet P is fed from the sheet container T by the feed roller 81. The sheet P is transported toward the second-transfer unit 50 in a direction indicated by an arrow C along the sheet transport path R by the transport rollers 82 and the registration roller 84. The registration roller 84 sends the sheet P to the second-transfer unit 50 on the basis of a timing at which the toner images are transferred onto the intermediate transfer belt 30. The second-transfer unit 50 transfers the toner images on the intermediate transfer belt 30 onto the sheet P. The sheet P having the toner images transferred thereon is transported by the transport belt 85 from the second-transfer unit 50 to the fixing device 60 where the toner images transferred on the sheet P are fixed thereto. Accordingly, an image is formed on the sheet P. The sheet P having the image formed thereon is output to the outside of the image forming apparatus 1 by the output roller 86. After the transfer process by the second-transfer unit 50, the toners remaining on the intermediate transfer belt 30 are removed therefrom by a belt cleaner 70.

Fixing Device

Figure 2:
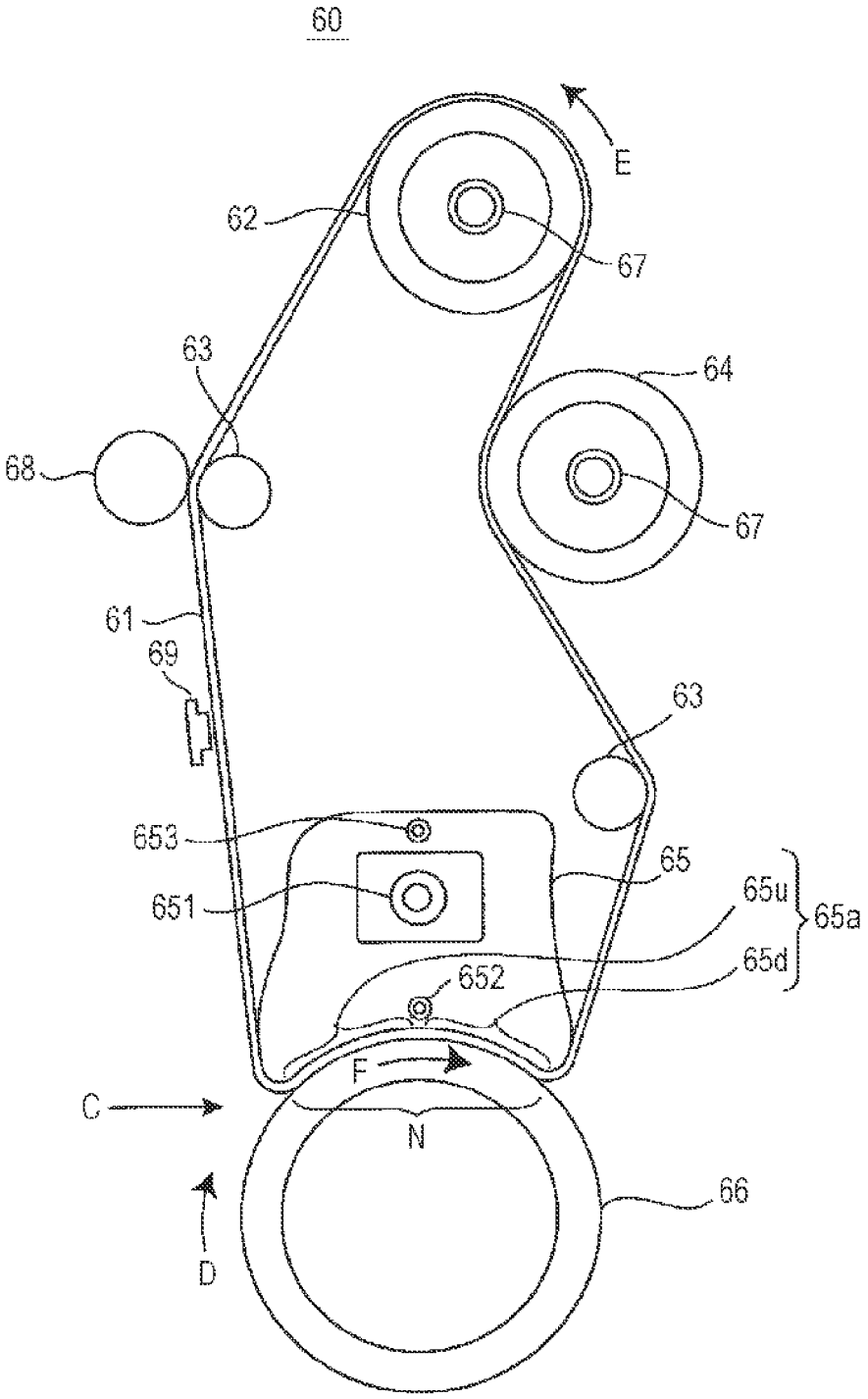
FIG. 2 illustrates an internal structure of a fixing device shown in FIG. 1.

FIG. 2 illustrates an internal structure of the fixing device 60 shown in FIG. 1.

The fixing device 60 shown in FIG. 1 includes an endless belt 61, a tension roller 62, two positioning rollers 63, an external heating roller 64, a pad member 65, a pressure roller 66, and a cleaning roller 68. The tension roller 62, the positioning rollers 63, the external heating roller 64, and the pressure roller 66 are rotatably supported by a frame (not shown) of the fixing device 60, whereas the pad member 65 is fixed to the frame.

The endless belt 61 is wrapped around the tension roller 62, the two positioning rollers 63, and the pad member 65. The endless belt 61 is formed of a base material coated with a rubber layer and a mold-release layer. For example, the base material is composed of polyimide, and the rubber layer is composed of silicone rubber. The mold-release layer is composed of fluorine-based resin, such as perfluoroalkoxy alkane (PFA). The endless belt 61 corresponds to an example of a belt according to an exemplary embodiment of the present invention.

The external heating roller 64 is pressed against the outer surface of the endless belt 61. Roller heaters 67 that heat the endless belt 61 are provided within the tension roller 62 and the external heating roller 64. A belt temperature sensor 69 that detects the temperature of the endless belt 61 is provided at a position facing the outer surface of the endless belt 61. The controller 1A controls the amount of heat generated by the roller heaters 67 on the basis of the temperature detected by the belt temperature sensor 69.

The cleaning roller 68 is provided at a position opposed to one of the positioning rollers 63 with the endless belt 61 interposed therebetween. The cleaning roller 68 removes foreign matter from the endless belt 61 after the toner-image fixing process.

The pad member 65 is disposed so as to abut on the inner surface of the endless belt 61. The pad member 65 is composed of, for example, a metallic material and substantially has a rectangular parallelepiped shape extending longitudinally along the rotation axes of the external heating roller 64 and the pressure roller 66. One of the side surfaces of the pad member 65 that faces the pressure roller 66 serves as a sliding surface 65*a* that abuts on the inner surface of the endless belt 61. The pad member 65 corresponds to an example of a pad member according to an exemplary embodiment of the present invention.

A pad heater 651 that heats the pad member 65 is provided inside the pad member 65. Furthermore, inside the pad member 65, a first pad temperature sensor 652 is provided between the pad heater 651 and the sliding surface 65*a*, and a second pad temperature sensor 653 that detects the temperature is provided opposite the sliding surface 65*a* with the pad heater 651 interposed therebetween.

The first pad temperature sensor 652 detects the temperature in an area between the pad heater 651 and the sliding surface 65*a* in the pad member 65. The second pad temperature sensor 653 detects the temperature in an area opposite the sliding surface 65*a* with the pad heater 651 interposed therebetween in the pad member 65.

The fixing device 60 has two kinds of heat sources, namely, first heating sources and a second auxiliary heating source. The first heating sources correspond to the roller heaters 67 built within the tension roller 62 and the external heating roller 64 and are used for heating the endless belt 61. The second auxiliary heating source corresponds to the pad heater 651 built within the pad member 65 and heats the endless belt 61 via the pad member 65. The pad heater 651 heats the pad member 65 so as to prevent the pad member 65 from absorbing heat from the endless belt 61. Furthermore, the pad heater 651 increases an apparent heat capacity of the endless belt 61 (including the heat capacity of the pad member 65) so as to suppress a sudden temperature decrease in the endless belt 61.

Figure 3:
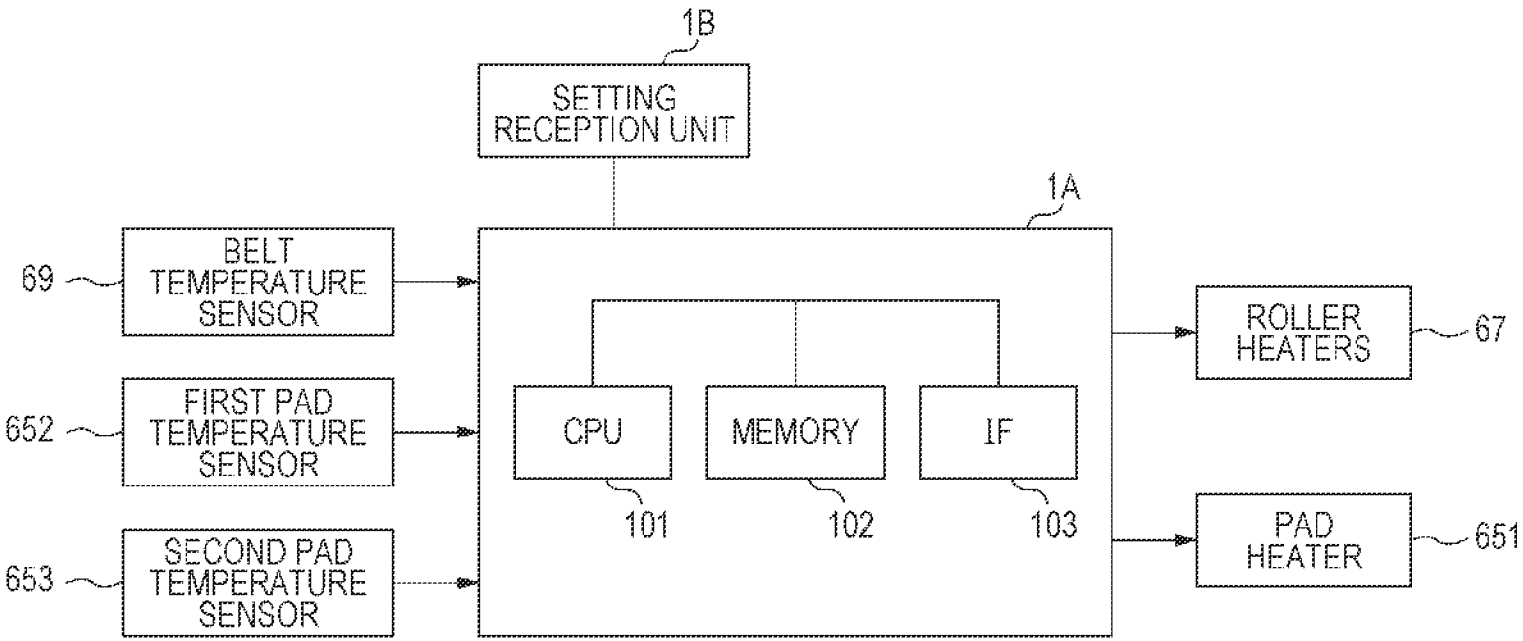
FIG. 3 is a block diagram illustrating an electrical configuration related to heaters and temperature sensors in the fixing device shown in FIG. 2.

FIG. 3 is a block diagram illustrating an electrical configuration related to the heaters and the temperature sensors in the fixing device 60 shown in FIG. 2.

The controller 1A includes a central processing unit (CPU) 101 that performs arithmetic processing, a memory 102 as a storage medium that stores data and programs to be executed by the CPU 101, and an interface (IF) 103 that exchanges signals with the components in the fixing device 60. The controller 1A controls the amount of heat generated by the roller heaters 67 on the basis of the temperature detected by the belt temperature sensor 69, and also controls the amount of heat generated by the pad heater 651 on the basis of the temperatures detected by the two pad temperature sensors 652 and 653. The controller 1A is connected to a setting reception unit 1B that receives information indicating the type of sheet to be supplied to the fixing device 60 from the sheet transport unit 80. The setting reception unit 1B is, for example, a touch-screen operable by an operator.

The fixing device 60 will be described below with reference to FIG. 2. The pressure roller 66 is disposed so as to press the outer surface of the endless belt 61 toward the sliding surface 65*a* of the pad member 65. With the pressing of the pressure roller 66, a pressure region (nip) N for nipping the sheet P is formed between the pressure roller 66 and the endless belt 61 whose inner surface abuts on the sliding surface 65*a* of the pad member 65.

The pressure roller 66 is rotationally driven by a driving mechanism (not shown) in a direction indicated by an arrow D in the state where the nip N is formed. The rotation of the pressure roller 66 causes the endless belt 61 to rotate. Specifically, when the pressure roller 66 rotates, the endless belt 61 rotates in a direction indicated by an arrow E in accordance with the rotation of the pressure roller 66. During the rotation of the endless belt 61, the endless belt 61 slides on the sliding surface 65*a* of the pad member 65.

The sheet P transported in the direction of the arrow C enters the nip N formed between the pressure roller 66 and the endless belt 61, and the pressure roller 66 applies pressure onto the sheet P together with the endless belt 61. While the sheet P passes through the nip N in a moving direction F, the unfixed toner images on the sheet P become fixed onto the sheet P due to the heat and the pressure applied thereto from the endless belt 61 and the pressure roller 66.

The sliding surface 65*a* of the pad member 65 according to this exemplary embodiment has a recessed surface in conformity to the cylindrical peripheral surface of the pressure roller 66 so as to ensure a sufficient length for the nip N. Specifically, assuming that the sliding surface 65*a* is divided into an upstream region and a downstream region in the moving direction F, a first curved surface 65*u* in the upstream region and a second curved surface 65*d* in the downstream region both are recessed surfaces in the moving direction F of the endless belt 61. In this exemplary embodiment, the average curvature of the first curved surface 65*u* in the upstream region is larger than that of the second curved surface 65*d* in the downstream region.

Shape of Sliding Surface

When the pressure roller 66 rotates, the endless belt 61 receives a driving force in the extending direction, that is, the moving direction F, of the endless belt 61 at the nip N. Because the endless belt 61 is pressed against the sliding surface 65*a* of the pad member 65 by the pressure roller 66, a shearing force is generated in the endless belt 61 in the moving direction F thereof due to the friction between the endless belt 61 and the sliding surface 65*a*. The endless belt 61 becomes distorted by expanding and contracting in the moving direction F at the nip N.

FIGS. 4A to 4D illustrate the shape of the sliding surface 65*a* and distortion of the endless belt 61 at the nip N.

Figures 4A, 4B, 4C, 4D:
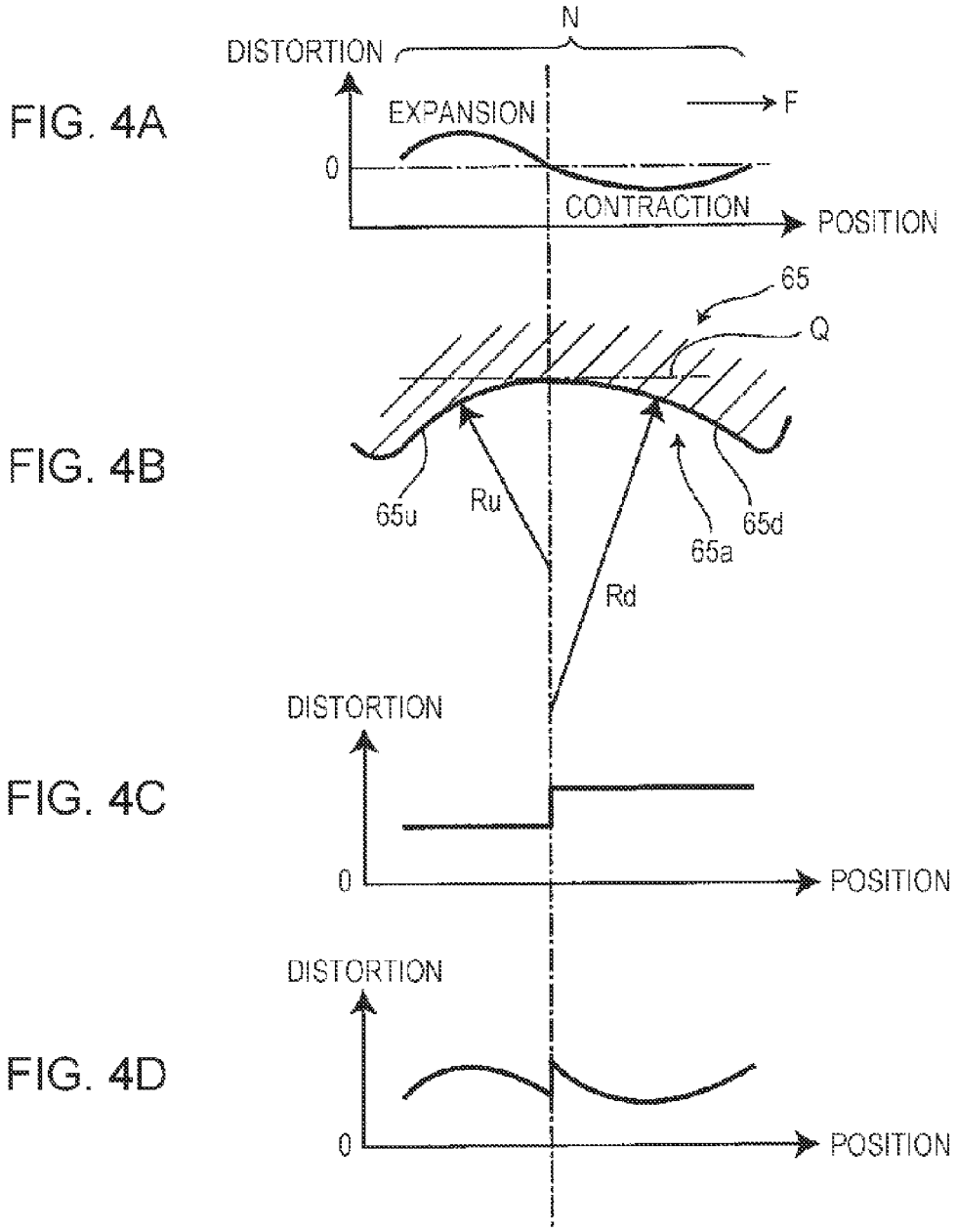
FIGS. 4A to 4D illustrate the shape of a sliding surface and distortion occurring at a nip of an endless belt.

FIG. 4A is a reference graph illustrating the distortion of the endless belt 61 at the nip N, assuming that the sliding surface 65*a* of the pad member 65 shown in FIG. 2 is a curved surface having a single curvature. The horizontal axis of the graph denotes the position of the endless belt 61 in the moving direction F at the nip N. The vertical axis denotes the amount of distortion of the endless belt 61. Specifically, the amount of expansion or contraction increases with increasing distance from zero.

If the sliding surface 65*a* is a curved surface having a single curvature, the endless belt 61 is driven so as to be pulled in the moving direction F by the pressure roller 66 at the upstream side in the moving direction F, resulting in a relatively larger amount of expansion. Because the expansion of the endless belt 61 is elastic deformation, the amount of expansion decreases as the endless belt 61 moves. At the downstream side in the moving direction F, contraction occurs since the expansion, which is elastic deformation, occurring at the upstream side is released. When the expansion and contraction of the endless belt 61 at the nip N exceed the limit of a frictional force between the endless belt 61 and the sheet P, the endless belt 61 slips relative to the sheet P, possibly resulting in the occurrence of smearing or blurriness of the toner images on the sheet P or creases in the sheet P.

The amount by which the endless belt 61 contracts due to the driving of the pressure roller 66 varies depending on the curvature of the sliding surface 65*a*. Specifically, the larger the curvature of the sliding surface 65*a*, the larger the amount of contraction (distortion). In contrast, the smaller the curvature of the sliding surface 65*a*, the smaller the amount of contraction (distortion).

FIG. 4B illustrates the shape of the sliding surface 65*a* of the pad member 65 according to this exemplary embodiment.

In the sliding surface 65*a* of the pad member 65, the first curved surface 65*u* in the upstream region has an average curvature that is larger than that of the second curved surface 65*d* in the downstream region. More specifically, the first curved surface 65*u* at the upstream side has a substantially circular-arc shape with a curvature radius Ru, whereas the second curved surface 65*d* at the downstream side has a substantially circular-arc shape with a curvature radius Rd. The curvature radius Ru at the upstream side is smaller than the curvature radius Rd at the downstream side. The first curved surface 65*u* is connected to the second curved surface 65*d* by sharing a common tangential plane Q with the second curved surface 65*d*.

FIG. 4C is a graph hypothetically illustrating average distortion in the endless belt 61 with reference to average distortion in the first curved surface 65*u* and the second curved surface 65*d*.

Based on a comparison between the first curved surface 65*u* and the second curved surface 65*d*, an average amount of contraction in the first curved surface 65*u* is relatively large due to having a large curvature. In contrast, an average amount of contraction in the second curved surface 65*d* is relatively small.

FIG. 4D is a graph illustrating the distortion of the endless belt 61 at the sliding surface 65*a* in this exemplary embodiment shown in FIG. 4B.

The distortion shown in the graph in FIG. 4D corresponds to a combination of the distortion shown in FIG. 4A and the distortion shown in FIG. 4C. Specifically, with regard to the first curved surface 65*u* and the second curved surface 65*d* in the sliding surface 65*a* according to this exemplary embodiment, a difference in distortion caused by different curvatures thereof tends to reduce a difference in distortion caused by the first curved surface 65*u* and the second curved surface 65*d* being respectively located at the upstream side and the downstream side. Therefore, the amplitude of distortion (i.e., a difference between a maximum value and a minimum value) occurring at the nip N is smaller than in the case where the sliding surface is a curved surface having a single curvature, as in FIG. 4A. Therefore, the occurrence of defects in the image or creases in the sheet P caused by a slippage of the endless belt 61 relative to the sheet P may be reduced, as compared with the case where the sliding surface is a curved surface having a single curvature.

Because the first curved surface 65*u* and the second curved surface 65*d* in the sliding surface 65*a* according to this exemplary embodiment are connected to each other by having the common tangential plane Q, a local slippage of the endless belt 61 at the boundary between the first curved surface 65*u* and the second curved surface 65*d* may be reduced, as compared with a case where the common tangential plane Q is not provided.

Furthermore, since the first curved surface 65*u* and the second curved surface 65*d* according to this exemplary embodiment both have a substantially circular-arc shape, the shape of the sliding surface 65*a* of the pad member 65 is simple, as compared with a case where the curved surfaces do not have a circular-arc shape. Therefore, the manufacturing process and the curvature setting process for reducing distortion of the belt are simplified, as compared with a case where the curved surfaces have shapes other than the circular-arc shape.

Shape Maintaining Control

A change in the shape of the pad member 65 will now be described with reference to FIG. 2. During the fixing process of the fixing device 60 shown in FIG. 2, the roller heaters 67 as first heating sources heat the endless belt 61 via the tension roller 62 and the external heating roller 64. Moreover, the pad heater 651 as a second auxiliary heating source heats the pad member 65.

The sliding surface 65*a* of the pad member 65 is in surface contact with the endless belt 61. Therefore, the temperature of an area including the sliding surface 65*a* of the pad member 65 is susceptible to the heat from the endless belt 61. More specifically, the temperature of the area including the sliding surface 65*a* of the pad member 65 increases as the temperature of the endless belt 61 is increased by being heated by the roller heaters 67, and decreases as the temperature of the endless belt 61 is decreased due to the sheet P passing through the nip N. On the other hand, an area opposite the sliding surface 65*a* with the pad member 651 interposed therebetween is relatively less susceptible to the temperature of the endless belt 61. More specifically, the temperature of this area is based on the amount of heat supplied from the pad heater 651 and the amount of heat released toward the upper surface.

The pad member 65 changes in shape due to thermal expansion in accordance with a temperature change in each area. With regard to the shape of the pad member 65, the aforementioned shape of the sliding surface 65*a* is preset based on the temperature distribution during a standard fixing process. If a temperature difference between the area including the sliding surface 65*a* and the area opposite thereto fluctuates due to a temperature change in the area including the sliding surface 65*a*, the pad member 65 changes in shape, resulting in a change in the preset shape of the sliding surface 65*a*.

In the fixing device 60 according to this exemplary embodiment, the amount of heat generated by the pad heater 651 as a second auxiliary heating source is controlled on the basis of the temperature detected by the first pad temperature sensor 652 provided inside the pad member 65 and the temperature detected by the second pad temperature sensor 653.

Figure 5:
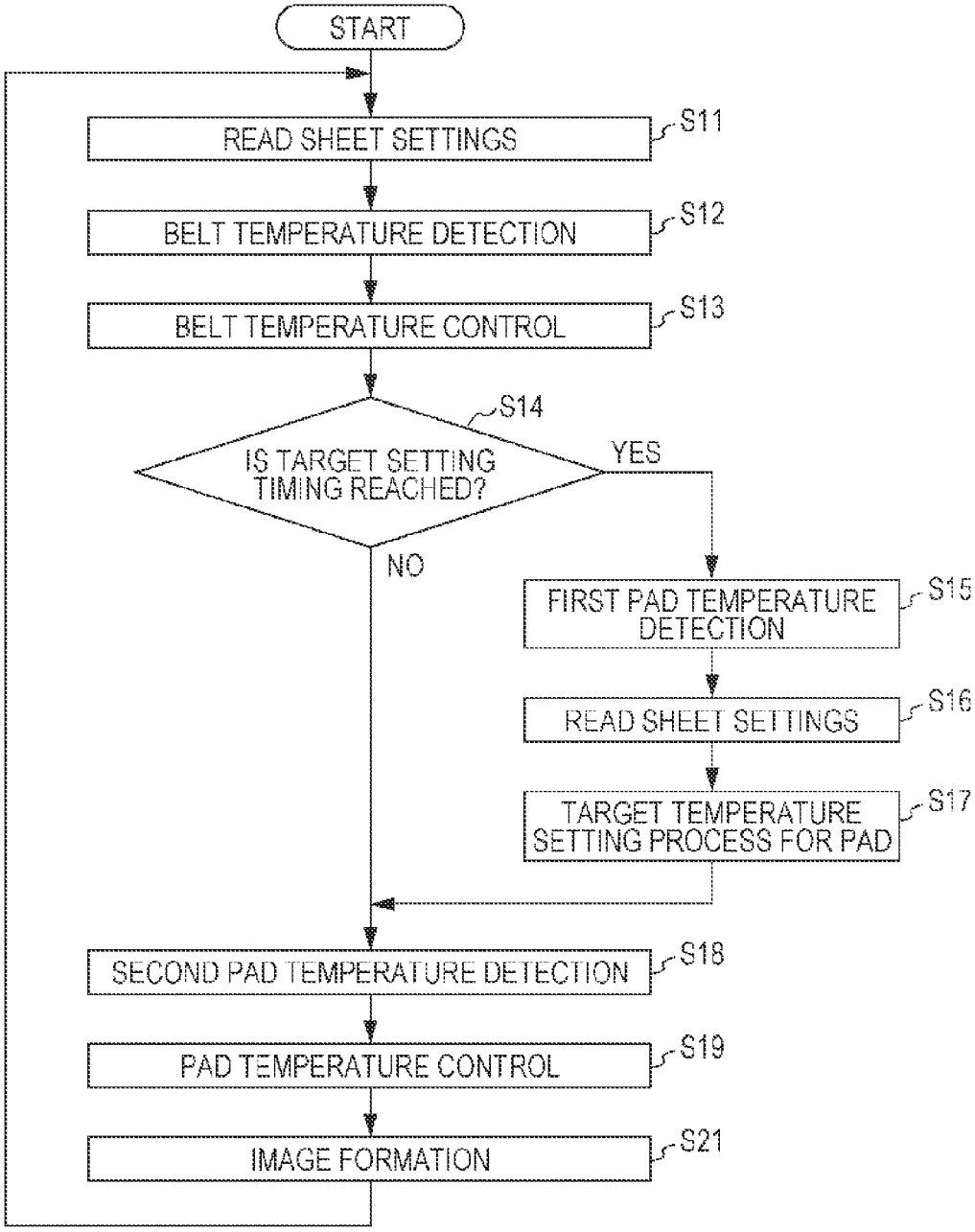
FIG. 5 is a flowchart illustrating the operation of the image forming apparatus.

FIG. 5 is a flowchart illustrating the operation of the image forming apparatus 1.

The operation of the image forming apparatus 1 including the fixing device 60 is controlled by the controller 1A. First, in step S11, the controller 1A reads, from the setting reception unit 1B, the settings for the type of sheet to be supplied to the fixing device 60. In step S12, the controller 1A detects the temperature of the endless belt 61 on the basis of a detection result of the belt temperature sensor 69. In step S13, the controller 1A performs belt temperature control so that the endless belt 61 reaches a target temperature set in accordance with the type of sheet. Specifically, the controller 1A controls the percentage of a time period during which the roller heaters 67 are turned on in accordance with a difference between the target temperature and the temperature of the endless belt 61, so as to adjust the amount of heat generated by the roller heaters 67. By repeating steps S12 and S13, the temperature of the endless belt 61 approaches the target temperature set in accordance with the type of sheet.

In step S14, the controller 1A determines whether or not a target temperature setting timing for the pad member 65 is reached. The target temperature setting timing is set at a longer interval than the repeating interval of the flow shown in FIG. 5. The target temperature setting timing is set to a rate of, for example, about once every three seconds.

If the target temperature setting timing is reached (YES in step S14), the controller 1A detects the temperature of an area between the sliding surface 65*a* and the pad heater 651 in the pad member 65 on the basis of a detection result of the first pad temperature sensor 652 in step S15. Then, the controller 1A reads the settings for the type of sheet in step S16 and performs a target temperature setting process for the pad member 65 in step S17. In this target temperature setting process, the controller 1A sets a target temperature on the basis of the temperature detected by the first pad temperature sensor 652.

FIG. 6 is a table illustrating the relationship between the temperature detected by the first pad temperature sensor 652 and the target temperature.

If the sheet P is plain paper, which is thinner than thick paper, the controller 1A sets the target temperature to a preset temperature different from, e.g., 30° C. higher than, the temperature detected by the first pad temperature sensor 652. However, if the detected temperature is higher than or equal to an upper limit temperature (e.g., 200° C.) for the pad member 65, the target temperature is maintained at the upper limit temperature. Although the target temperature setting process is performed by, for example, reading data from a memory that preliminarily stores the correspondence relationship shown in FIG. 6, the process may alternatively be performed based on calculation. In this exemplary embodiment, plain paper is a sheet of paper with a basis weight smaller than 106 $g/m^2$, whereas thick paper is a sheet of paper with a basis weight larger than or equal to 106 $g/m^2$.

Next, in step S18, the controller 1A detects the temperature of the area of the pad member 65 (see FIG. 2) opposite the sliding surface 65*a* with the pad heater 651 interposed therebetween by using the second pad temperature sensor 653. In step S19, the controller 1A controls the pad heater 651 so that the detected temperature becomes equal to the target temperature set in step S17. Specifically, the controller 1A controls the percentage of a time period during which the pad heater 651 is turned on so as to adjust the amount of heat generated by the pad heater 651. By repeating steps S18 and S19, the temperature of the area of the second pad temperature sensor 653 in the pad member 65 approaches the target temperature. In other words, the difference between the temperature detected by the second pad temperature sensor 653 and the temperature detected by the first pad temperature sensor 652 becomes about 30° C.

Subsequently, in step S21, the controller 1A controls each component of the image forming apparatus 1 so as to perform a process for image formation.

In the fixing device 60 according to this exemplary embodiment, temperature-difference control is performed in steps S18 and S19 described above. Therefore, a change in the shape of the pad member 65 due to thermal expansion thereof during the fixing process may be reduced so that fluctuations in the shape of the sliding surface 65*a* may also be reduced, as compared with a case where the aforementioned temperature-difference control is not performed. Furthermore, in the fixing device 60 according to this exemplary embodiment, the target temperature setting process is performed in steps S15 and S17 described above. Therefore, fluctuations in the shape of the sliding surface 65*a* may be reduced, while the temperature of the pad member 65 may comply with the temperature change in the endless belt 61, unlike a case where the aforementioned target temperature setting process is not performed.

If the sheet P set in the sheet settings is thick paper having a thickness greater than a predetermined thickness, the fixing device 60 sets a target temperature that is higher than that for plain paper. Specifically, if the sheet P is thick paper, the controller 1A sets the target temperature to a temperature higher than the temperature detected by the first pad temperature sensor 652 by 50° C., as shown in the table in FIG. 6, in steps S16 and S17 described above. In the case of thick paper, the occurrence of creases in the sheet P caused by fluctuations in the shape of the sliding surface 65*a* is low. On the other hand, because thick paper has a greater heat capacity than plain paper, the temperature of the endless belt 61 decreases by a large amount as a result of the fixing process. In that case, in the fixing device 60 according to this exemplary embodiment, the target temperature for the pad member 65 is set to a higher value than in the case of plain paper. Therefore, the amount of supplied heat is greater than in a case where the temperature setting process is not performed in this manner, whereby the amount of decrease in the temperature of the endless belt 61 as a result of processing thick paper may be reduced.

In the exemplary embodiment described above, the fixing device 60 having the endless belt 61 wrapped around the tension roller 62, the positioning rollers 63, and the pad member 65 is described as an example of a fixing device according to an exemplary embodiment of the present invention. Alternatively, for example, a configuration in which the belt 61 is wrapped around the pad member 65 but not around the rollers such that tension is not applied to the belt 61 may be permissible.

In the exemplary embodiment described above, the pad member 65 against which the endless belt 61 is directly pressed is described as an example of a pad member according to an exemplary embodiment of the present invention. Alternatively, for example, the pad member may include a sliding sheet that intervenes the pad member and the belt 61. Furthermore, in the exemplary embodiment described above, the pad member 65 composed of a metallic material is described as an example of a pad member according to an exemplary embodiment of the present invention. Alternatively, for example, the pad member itself may be composed of a resinous material.

In the exemplary embodiment described above, a tandem-type color printer is described as an example of an image forming apparatus. Alternatively, the image forming apparatus according to the exemplary embodiment of the present invention may be, for example, a monochrome printer that does not have an intermediate transfer belt.

In the exemplary embodiment described above, a printer is described as an example of an image forming apparatus. Alternatively, the image forming apparatus according to the exemplary embodiment of the present invention is not limited to a printer, but may be, for example, a copier or a facsimile apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

an endless belt configured to rotate;

a heating source configured to heat the belt;

a pad member comprising a sliding surface abutting on an inner surface of the belt; and a pressure roller configured to press an outer surface of the belt toward the sliding surface to form a nip portion that an unfixed toner image onto a medium is fixed, wherein, the nip portion comprises an upstream region and a downstream region in a moving direction of the belt moving along the upstream region and the downstream region of the nip portion, and wherein a first curved surface corresponding to the upstream region has an average curvature that is larger than that of a second curved surface corresponding to the downstream region.

2. The fixing device according to claim 1, wherein both the first curved surface and the second curved surface are substantially circular-arc curved surfaces in the moving direction.

3. The fixing device according to claim 1, wherein the first curved surface is connected to the second curved surface by sharing a common tangential plane with the second curved surface.

4. The fixing device according to claim 1, wherein the pressure roller is configured to rotate so as to rotate the belt, the pressure roller is configured to work together with the belt so as to fix an unfixed toner image onto a medium that bears the unfixed toner image by allowing the medium to enter between the pressure roller and the belt.

5. The fixing device according to claim 1, wherein each of the upstream region and the downstream region comprises a recessed curved surface corresponding to a curvature of the pressure roller.

6. The fixing device according to claim 1, wherein a center of a radius of curvature of the first curved surface and a center of a radius of curvature of the second curved surface are provided on an outer side of the outer surface of the belt.

7. The fixing device according to claim 1, wherein the first curved surface and the second curved surface correspond to a pressure region of the pressure roller configure to nip a medium between the pressure roller and the endless belt.

8. The image forming apparatus according to claim 1, wherein the heating source is provided inside the pad member.

9. The image forming apparatus according to claim 1, wherein a pad temperature sensor that detects a temperature is provided between the upstream region and a downstream region.

10. An image forming apparatus comprising:

an image forming section that forms an electrostatic latent image, develops the electrostatic latent image by using a toner so as to form a toner image, and transfers the toner image onto a medium; and a fixing section that fixes the toner image, which is transferred to the medium and is in an unfixed state, onto the medium, wherein the fixing section includes an endless belt configured to rotate;

a heating source configured to heat the belt;

a pad member comprising a sliding surface abutting on an inner surface of the belt; and a pressure roller configured to press an outer surface of the belt toward the sliding surface to form a nip portion that an unfixed toner image onto a medium is fixed, wherein, the nip portion comprises an upstream region and a downstream region in a moving direction of the belt moving along the upstream region and the downstream region of the nip portion, and wherein a first curved surface corresponding to the upstream region has an average curvature that is larger than that of a second curved surface corresponding to the downstream region.

11. The image forming apparatus according to claim 10, wherein the pressure roller is configured to rotate so as to rotate the belt, the pressure roller is configured to work together with the belt so as to fix an unfixed toner image onto a medium that bears the unfixed toner image by allowing the medium to enter between the pressure roller and the belt.

12. The image forming apparatus according to claim 10, wherein each of the upstream region and the downstream region comprises a recessed curved surface corresponding to a curvature of the pressure roller.

13. The image forming apparatus according to claim 10, wherein a center of a radius of curvature of the first curved surface and a center of a radius of curvature of the second curved surface are provided on an outer side of the outer surface of the belt.

14. The image forming apparatus according to claim 10, wherein the first curved surface and the second curved surface correspond to a pressure region of the pressure roller configure to nip a medium between the pressure roller and the endless belt.

* * * * *